United States Patent [19]

Trousdell et al.

[11] Patent Number: 4,464,096

[45] Date of Patent: Aug. 7, 1984

[54] SELF-ACTUATING ROTOR SEAL

[75] Inventors: Edmund D. Trousdell; Peter E. Voyer, both of Tolland, Conn.

[73] Assignee: United Technologies Corporation, Hartford, Conn.

[21] Appl. No.: 90,189

[22] Filed: Nov. 1, 1979

[51] Int. Cl.[3] ..... F01D 5/30

[52] U.S. Cl. ..... 416/215; 416/221

[58] Field of Search ..... 416/215 A, 218, 221

[56] References Cited

U.S. PATENT DOCUMENTS

| | | | |
|---|---|---|---|
| 3,428,244 | 2/1969 | Palmer | 416/221 |
| 3,709,631 | 1/1973 | Karstowsen | 416/221 |
| 3,752,598 | 8/1973 | Bowers | 416/220 |
| 3,765,796 | 10/1973 | Stargardter | 416/218 |
| 3,972,645 | 8/1976 | Kasprow | 416/215 |
| 4,183,720 | 1/1980 | Brantley | 416/193 A |

*Primary Examiner*—William L. Freeh

*Attorney, Agent, or Firm*—Gene D. Fleischhauer

[57] ABSTRACT

A rim seal for blocking the leakage of working medium gases between an array of rotor blades and a rotor disk is disclosed. Various construction details which provide positive contact between the seal and the disk are developed. The rim seal of the present invention is of the ladder-type having application to a disk adapted by a circumferential groove to receive the rotor blades.

8 Claims, 5 Drawing Figures

FIG. 2A
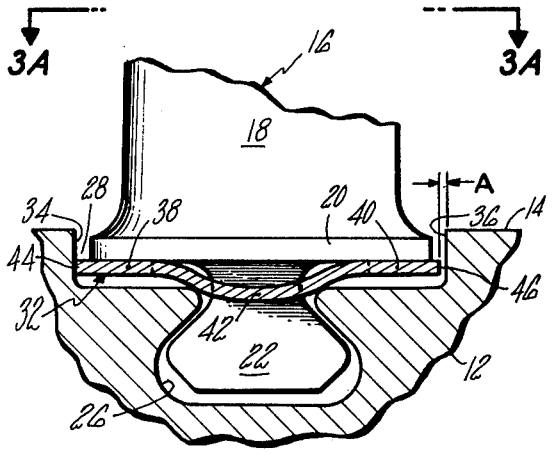
FIG. 2B
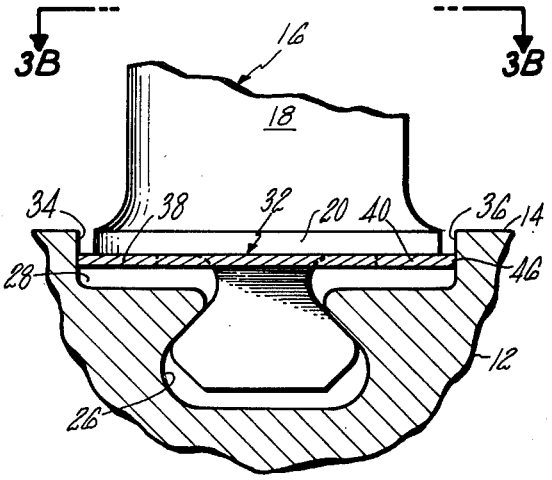
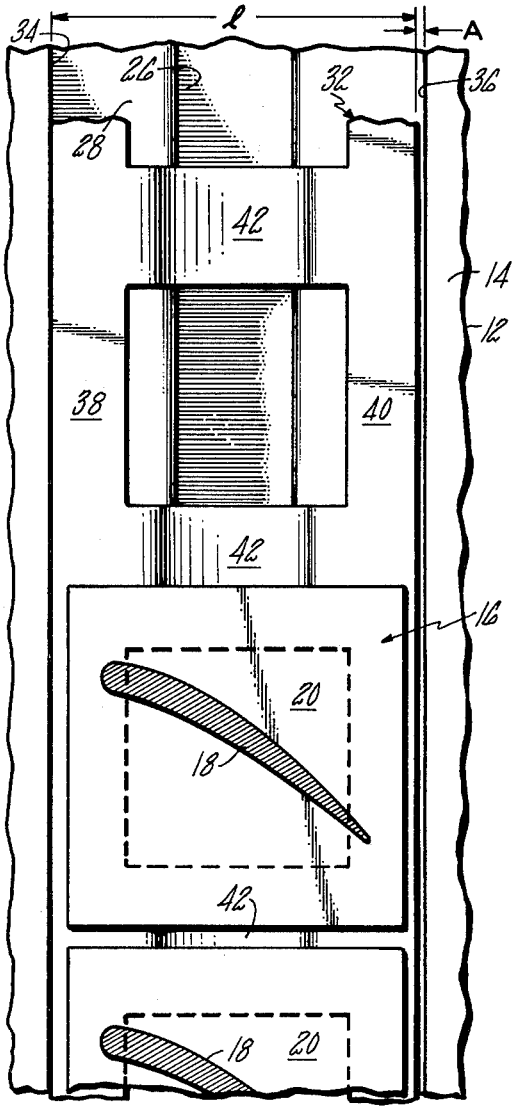
FIG. 3A
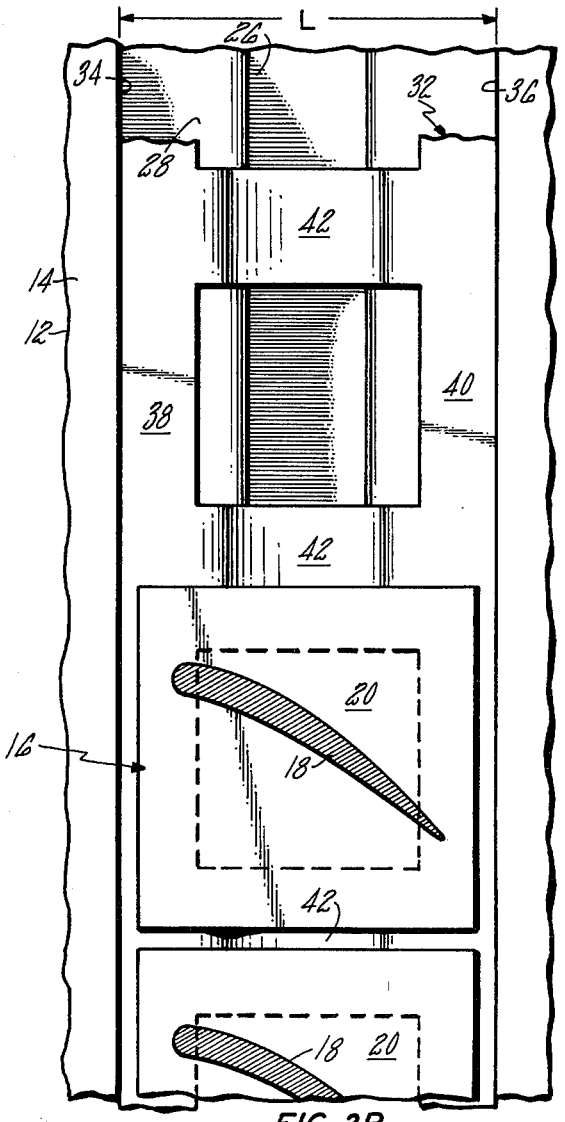
FIG. 3B

SELF-ACTUATING ROTOR SEAL

BACKGROUND OF THE INVENTION

1. Field of the Invention

This invention relates to gas turbine engines, and more particularly to a seal member disposed between the platforms of an array of rotor blades and a rotor disk.

2. Description of the Prior Art

A gas turbine engine has a compression section, a combustion section and a turbine section. A rotor extends axially through the compression section and the turbine section. Each rotor has at least one rotor disk and a plurality of outwardly extending airfoil-shaped rotor blades. A working medium flowpath extends axially between the rotor blades. The rotor blades have platforms which cooperate to provide a boundary to the flowpath. Working medium gases directed along the flowpath through the blades, receive energy from the blades in the compression section and impart energy to the blades in the turbine section.

Because the platforms of the blades are spaced from each other and from the disk sidewalls leaving gaps therebetween, the working medium gases in some constructions leak from the prescribed flowpath at a region of high pressure by flowing through the gaps, under the platforms into the spaces between the platforms and the disk, and thence out into the flowpath at a region of lower pressure. Structures having the sealing effectiveness to block such leakage are required to avoid adverse effects on the performance of the engine.

One example of a structure blocking the leakage of working medium gases between adjacent platforms is shown in U.S. Pat. No. 3,972,645 to Kasprow. Kasprow provides a ladder-type rim seal having circumferentially spaced crossbars interconnected at opposite ends by longitudinally extending strips integral with the crossbars at the end.

Easy assembly of the rim seal and the rotor blades to the rotor disk is known to be desirable and is provided in Kasprow by both a radial clearance and an axial clearance between the seal and the rotor disk. More importantly, effective sealing between adjacent blade platforms is provided by the ladder structure of Kasprow. Still, scientists and engineers continue to seek more effective rim seals while maintaining the facileness with which assembly is performed.

SUMMARY OF THE INVENTION

A primary object of the present invention is to increase the sealing effectiveness of a seal structure which extends circumferentially between an array of rotor blade platforms and a rotor disk. Another object is to block the leakage of working medium gases between the platforms and adjacent rotor blades and between the array of rotor blades and the disk. Still another object is to provide a seal structure which easily slides into place during assembly.

According to the present invention, a rim seal disposed between a rotor disk and the platforms of adjacent rotor blades presses against the rotor disk and the blade platforms in response to operative forces to block the leakage of working medium gases between adjacent blade platforms and between blade platforms and the rotor disk.

A primary feature of the present invention is the rim seal disposed between the rotor disk and the blade platforms. The rotor disk has a platform groove. An upstream sidewall and a downstream sidewall bound the groove. The rim seal has an upstream strip in proximity to the upstream sidewall and a downstream strip in proximity to the downstream sidewall. The rim seal in at least one embodiment has an arcuate center portion. The flattened length of the rim seal is greater than the unflattened length of the rim seal. The length of the unflattened rim seal in the installed position is less than the width of the groove between sidewalls.

A primary advantage of the present invention is the increase in sealing effectiveness which results from the blockage of the leakage of working medium gases. A concomitant increase in engine efficiency results. The leakage of working medium gases is blocked by the rim seal which engages the rotor disk and blade platforms in response to operational forces. Another advantage is the ease of assembly which results from the axial gap between the rim seal and corresponding sidewalls at assembly.

The foregoing and other objects, features and advantages of the present invention will become more apparent in the light of the following detailed description of preferred embodiments thereof as discussed and illustrated in the accompanying drawing.

BRIEF DESCRIPTION OF THE DRAWING

FIG. 2*a* is a sectional view taken along the lines 2*a*—2*a* as shown in FIG. 1 illustrating the rim seal of the present invention at rest.

FIG. 2*b* is a sectional view corresponding to FIG. 2*a* illustrating the rim seal of the present invention as expanded under rotational loads.

FIG. 3*a* is a developed sectional view taken in the direction 3*a*—3*a* as shown in FIG. 2*a* with portions of the blade platforms broken away.

FIG. 3*b* is a developed sectional view of FIG. 2*b*, corresponding to the FIG. 3*a* view, illustrating the rim seal of the present invention as expanded under rotational loads.

DESCRIPTION OF THE PREFERRED EMBODIMENT

Figure 1:
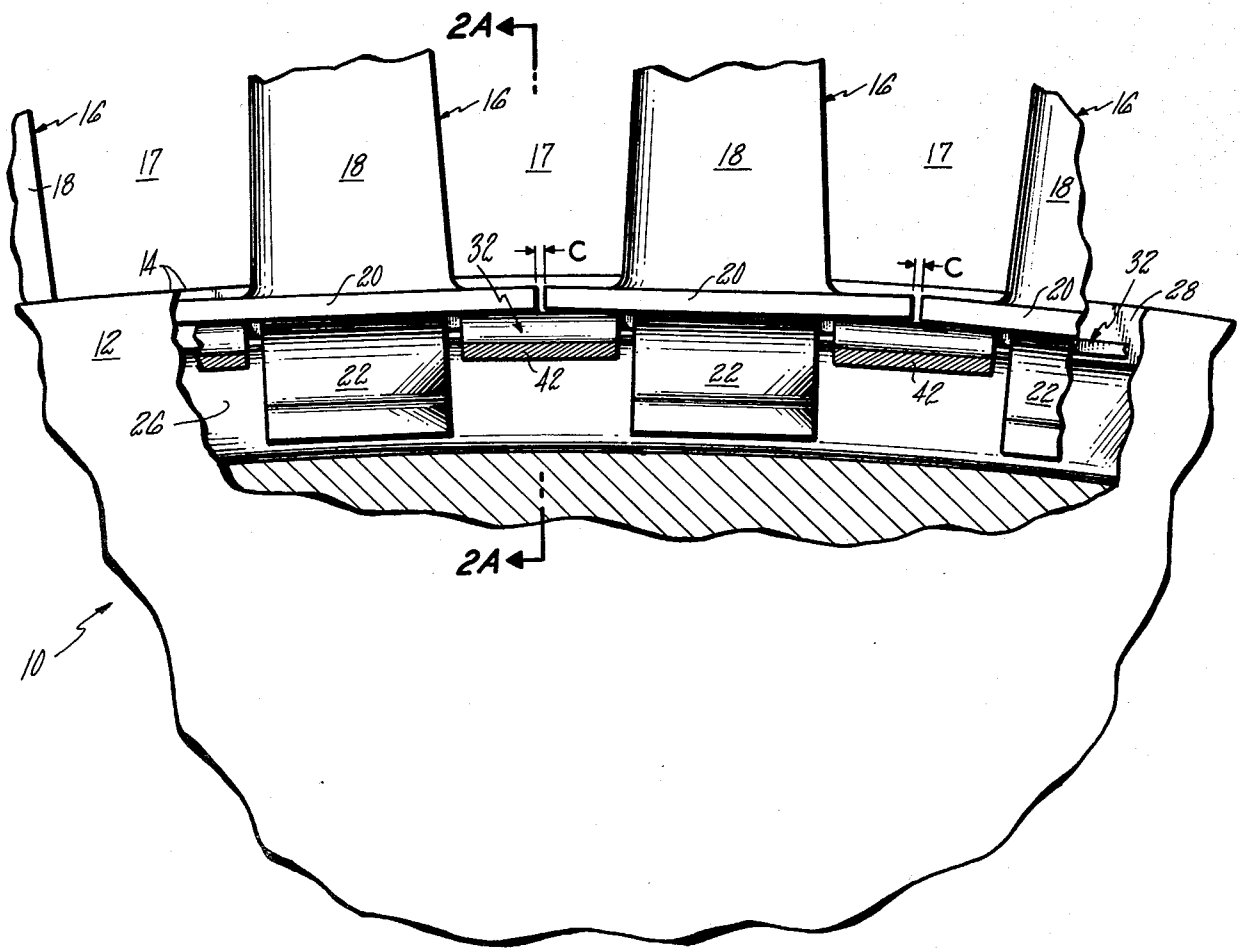
FIG. 1 is a simplified front view of a portion of a rotor assembly including portions broken away to illustrate the rim seal of the present invention.

A gas turbine engine embodiment of the invention is illustrated in the FIG. 1 view. A portion of the rotor assembly 10 of the engine is shown. The rotor assembly includes a rotor disk 12 having a rim 14 and a plurality of rotor blades 16 extending outwardly from the rim. A flowpath for working medium gases 17 extends between the rotor blades. Each rotor blade has an airfoil section 18, a platform section 20 and a root section 22. A slot 26 extending circumferentially about the rim of the disk and corresponding in shape to the root sections adapts the rim to receive the root sections of the rotor blades. A platform groove 28 extending circumferentially around the slot adapts the rim to receive the platform sections of the rotor blades. The platform sections of adjacent rotor blades are circumferentially spaced one from another leaving a gap C therebetween. A rim seal 32 is disposed in the platform groove beneath the blade platforms. The rim seal is made of a flexible material which bends in a rotational force field. One satisfactory material is annealed AMS (Aerospace Material Specification) 5504.

As shown in FIG. 2*a*, the platform groove is bounded by an upstream sidewall 34 and a downstream sidewall 36. The rim seal has an upstream strip 38 which extends circumferentially beneath adjacent blade platforms at the upstream sidewall and a downstream strip 40 which extends circumferentially beneath the adjacent blade platforms at the downstream sidewall. At least two circumferentially spaced crossbars, as represented by the single crossbar 42, extend axially beneath adjacent platforms between the upstream and downstream strips of the rim seal. The upstream strip has a leading edge 44 and the downstream strip has a trailing edge 46. The unflattened length l is the shortest distance between the leading edge and the trailing edge of the rim seal and in the installed position is an axial length parallel to the engine centerline. The flattened length L is the distance between the leading edge and the trailing edge of a flattened rim seal. In other words, the flattened length is equal to the linear distance across the contoured rim seal. The difference in length between the flattened length L and the unflattened length l is greater than the gap A, i.e. $(L-l)>A$.

FIG. 3*a* is a developed view of the structure shown in FIG. 2*a* and shows the unflattened length l of the rim seal.

FIG. 2*b* is a view corresponding to FIG. 2*a* and shows the rotor disk 12, the rim seal 32 and the rotor blade 14 during operation with the rim seal in an essentially unflattened state.

FIG. 3*b* is a developed view of FIG. 2 and shows the essentially flattened length L of the rim seal.

During operation of a gas turbine engine, working medium gases are directed along the working medium flowpath 18. The rotor assembly rotates at high speed exchanging energy with the working medium gases. Rotation of the rotor disk 12 results in a rotational force field causing the root section 22 of the rotor blade to press tightly against the top portion of the slot 26. The rotational force field also causes the rim seal to press against the underside of the platform section 20. At the operating speed of the rotor assembly, the rim seal flattens against the underside of the platform. As the seal flattens, the upstream strip 38 and the downstream strip 40 are urged into engagement with the sidewalls. The upstream strip presses tightly against the upstream sidewall 34 and the downstream strip presses tightly against the downstream sidewall 36. Depending on the material selected a small amount of buckling away from the underside of the platform by the rim seal may take place, a small amount of deformation of the upstream and downstream edges of the rim seal may take place or a combination of both may occur.

As shown, the rim seal may extend under several blade platforms and preferably extends over most of the rotor circumference. At assembly with the rim seal in the unflattened condition, the gap A provides an axial clearance between the edges 44, 46 of the rim seal and the sidewalls 34, 36 of the disk. The clearance enables the rim seal and the blades to slide in the circumferential slot 26 and groove 28 with a minimum of binding. Easy assembly of the rim seal and of the rotor blades is enabled.

As will be appreciated by those skilled in the art, any rim seal 32 in which the essentially flattened length L exceeds the unflattened length l by a distance which is greater than the gap A, i.e. $(L-l)>A$, will achieve the sealing advantage. In the implementation of this concept, the crossbar 42 may be curved in the axial direction with a concave shape (as illustrated) or a convex shape facing outwardly. In alternate constructions, the crossbar may have a series of planes extending in the axial direction having acute or obtuse angles with respect to each other. Similarly, the circumferentially extending downstream and upstream strips may have axially extending curves or planes capable of providing the increased length under rotational forces.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of our invention, that which we claim as new and desire to secure by Letters Patent of the United States is:

1. In a rotor disk of the type having a rim adapted by a circumferentially extending slot to receive the roots of a plurality of outwardly extending platform-type rotor blades wherein the slot is bounded by an upstream sidewall and a downstream sidewall, the improvement which comprises:

a rim seal disposed between the blade platforms and the rotor disk, the rim seal being spaced axially from at least one sidewall leaving a gap therebetween, the seal having an upstream strip which extends circumferentially beneath adjacent blade platforms at the upstream sidewall, a downstream strip which extends circumferentially beneath adjacent blade platforms at the downstream sidewall, at least two circumferentially spaced crossbars extending axially beneath adjacent platforms between the upstream and downstream strips of the rim seal;

wherein the rim seal is adapted to press against the upstream and downstream sidewalls of said disk and outwardly against the blade platforms in operative response to rotational forces.

2. The invention as claimed in claim 1 wherein the rim seal has an unflattened length as measured in the axial direction and a corresponding flattened length which is greater than the unflattened length.

3. The invention as claimed in claim 2 wherein at least two crossbars have an unflattened length as measured in the axial direction and a corresponding flattened length which is greater than the unflattened length.

4. The invention claimed in claim 3 wherein each of said crossbars has an arcuate surface.

5. The invention as claimed in claim 4 wherein each of said arcuate surfaces has a concave side facing the platforms of the adjacent pair of rotor blades.

6. The invention according to claim 1 wherein each of said crossbars has an arcuate center portion which is adapted to flatten in response to rotational forces during operation of the rotor disk in which the rim seal is installed.

7. For a gas turbine engine, a rim seal having:

a first strip extending in a first direction, a second strip spaced from the first strip and extending in the direction of the first strip, at least two crossbars having ends, each crossbar extending in a second direction substantially perpendicular to the first direction and joined integrally at one end to the first strip and joined integrally at the other end to the second strip, wherein the rim seal has an unflattened length as measured in the second direction and a corresponding flattened length which is greater than the unflattened length.

8. The invention according to claim 7 wherein the flattened length of the crossbar in the second direction is greater than the unflattened length of the crossbar in the second direction.

* * * * *